US006708734B2

(12) United States Patent
Rinehart

(10) Patent No.: US 6,708,734 B2
(45) Date of Patent: Mar. 23, 2004

(54) VIBRATIONAL REMOVAL OF EXCESS PARTICULATE MATTER

(75) Inventor: Steven R. Rinehart, Chesterfield, VA (US)

(73) Assignee: Philip Morris Incorporated, New York, NY (US)

( * ) Notice: Subject to any disclaimer, the term of this patent is extended or adjusted under 35 U.S.C. 154(b) by 2 days.

(21) Appl. No.: 10/055,668

(22) Filed: Jan. 23, 2002

(65) Prior Publication Data

US 2003/0136464 A1 Jul. 24, 2003

(51) Int. Cl.[7] ..... B65B 1/20

(52) U.S. Cl. ..... 141/12; 141/11; 141/12; 141/69; 141/73; 141/74; 141/131; 141/164; 264/442; 264/443

(58) Field of Search ..... 228/1.1, 110.1; 156/73.1, 73.2, 580.1, 580.2; 425/174.2; 264/442, 443, 444, 445; 118/621, 623, 626, 640, 696, 602, 104; 141/2, 11, 12, 67, 69, 73–75, 129, 164, 131; 131/284

(56) References Cited

U.S. PATENT DOCUMENTS 3,623,404 A * 11/1971 Jackson ..... 493/47
3,772,967 A * 11/1973 Burrus et al. ..... 493/47
4,198,166 A * 4/1980 Tuns ..... 366/112
4,804,550 A * 2/1989 Bardsley et al. ..... 426/397
5,520,738 A * 5/1996 Aindow et al. ..... 118/621
5,651,494 A 7/1997 Ogino et al.
5,772,814 A 6/1998 Grewell
5,875,824 A * 3/1999 Atwell et al. ..... 141/67
6,089,438 A 7/2000 Suzuki et al.
6,359,187 B1 * 3/2002 Lamoureux ..... 588/20

* cited by examiner

*Primary Examiner*—Timothy L. Maust
(74) *Attorney, Agent, or Firm*—Connolly Bove Lodge & Hutz LLP

(57) ABSTRACT

An assembly and method enhances particulate matter retention during the filling of a moving cavity. The assembly further reduces the tendency of particulate matter to come to rest at a point other than in the moving cavity. The assembly for enhancing particulate matter retention comprises a transport for continuously moving a stream of empty cavities in a downstream direction. The assembly further includes a feed for depositing particulate matter from a supply into the empty cavities on the transport. A vibrator engages the cavities on the transport thereby vibrating the cavities to enhance particulate matter retention within the cavities and to remove any excess particulate matter from areas adjacent the cavities. The assembly and method are particularly suited for efficiently filing cavities in a multiple component cigarette filter preform with carbon or similar type granules.

19 Claims, 2 Drawing Sheets

VIBRATIONAL REMOVAL OF EXCESS PARTICULATE MATTER

BACKGROUND OF THE INVENTION

The present invention relates to loading particulate matter into a plurality of moving cavities. In many industrial applications, it is desirable to load relatively fine particulate matter into a series of moving cavities at relatively high speeds. This loading is accomplished by dropping a precisely metered cascade of particulate matter into a preform holding the cavities. The cavities typically are formed between spaced-apart, solid components. While this approach is generally effective, it does suffer from some disadvantages. First, even with a large amount of material in the particulate matter cascade, it is not always possible to fill each cavity completely because the particulate matter does not always settle or compact completely into each cavity. Second, the particulate matter can settle on the solid components rather than fall into a cavity. This spilled material can interfere with the later sealing of the cavity.

The problem described above is particularly applicable to cigarette filter plug manufacture where it is well known to fill the cavities of a continuous filter preform with particulate matter such as carbon granules or some other smoke altering material prior to ultimate use in cigarette filters. These cavities are created between solid cellulose acetate plugs and are wrapped with a porous plug wrap paper. In the prior art, carbon granules deposited in the filter plug preform fill the majority of each cavity. However, it is desirable to maximize this filling as any empty space in a cavity adversely effects air flow in a finished cigarette. Air jets are used to clean the cellulose acetate material by removing any excess carbon granules therefrom. However, this procedure is somewhat unreliable to the extent of missing some of the granules on the cellulose acetate material and also unnecessarily removing some of the granules from the plug cavities.

SUMMARY OF THE INVENTION

Accordingly, one of the objects of the present invention is an assembly that enhances particulate matter retention during filling of a moving cavity of a filter plug preform.

Another object of the present invention is a method for enhancing retention of particulate matter in the cavities of a filter plug preform and for removing excess matter from the surface of the preform that includes the step of applying vibration to the preform in the vicinity where the particulate matter is deposited.

In accordance with the present invention, an assembly comprises a transport for continuously moving a filter plug preform in a downstream direction. A particulate matter supply is located in proximity to the transport, and a feed functions to deposit particulate matter from the supply into spaced apart cavities in the moving filter plug preform. A vibrator engages the filter plug preform on the transport to vibrate the preform and thereby enhance particulate matter retention in the cavities.

Preferable the vibrator is an ultrasonic vibrator such as an ultrasonic welder horn. Ultrasonic welder horns vibrate in excess of 20,000 cycles per second. Fundamentally, the vibration is subtle in nature and similar to that of a tuning fork. The present invention utilizes such intense controlled vibration as a cleaning tool, and the vibration is transferred to a filter plug preform as the preform moves along its path of travel during filter plug manufacture.

Particulate matter introduced to the vibrating filter plug preform bounce away from the preform and settle in designated surface cavities in the preform. The vibration functions to enhance particulate matter retention and also to remove a significant amount of any excess particulate matter from the preform.

Preferably, the assembly includes a vacuum source near the transport for removing any particulate matter and recycling that matter to the supply. Moreover, the ultrasonic welder horn may include a horn tip, and the horn tip may have a concave preform engaging surface. Such surface may extend less then 180° around the circumference of the perform cavity or more than 180°, as desired. Alternatively, the horn tip may have a convex preform engaging surface or a flat surface.

The particulate matter may comprise carbon granules loaded into the spaced apart cavities in a filter plug preform.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 3 is a fragmental side elevational view of the ultrasonic welder horn and filter plug preform of FIG. 1, according to the present invention;

FIG. 4 is a fragmental side elevational view of a modified ultrasonic welder horn, according to the present invention;

FIG. 5 is a fragmental side elevational view of another modified ultrasonic welder horn, according to the present invention; and FIG. 6 is a fragmental side elevational view of still another ultrasonic welder horn, according to the present invention.

DETAILED DESCRIPTION OF THE INVENTION

Figure 1:
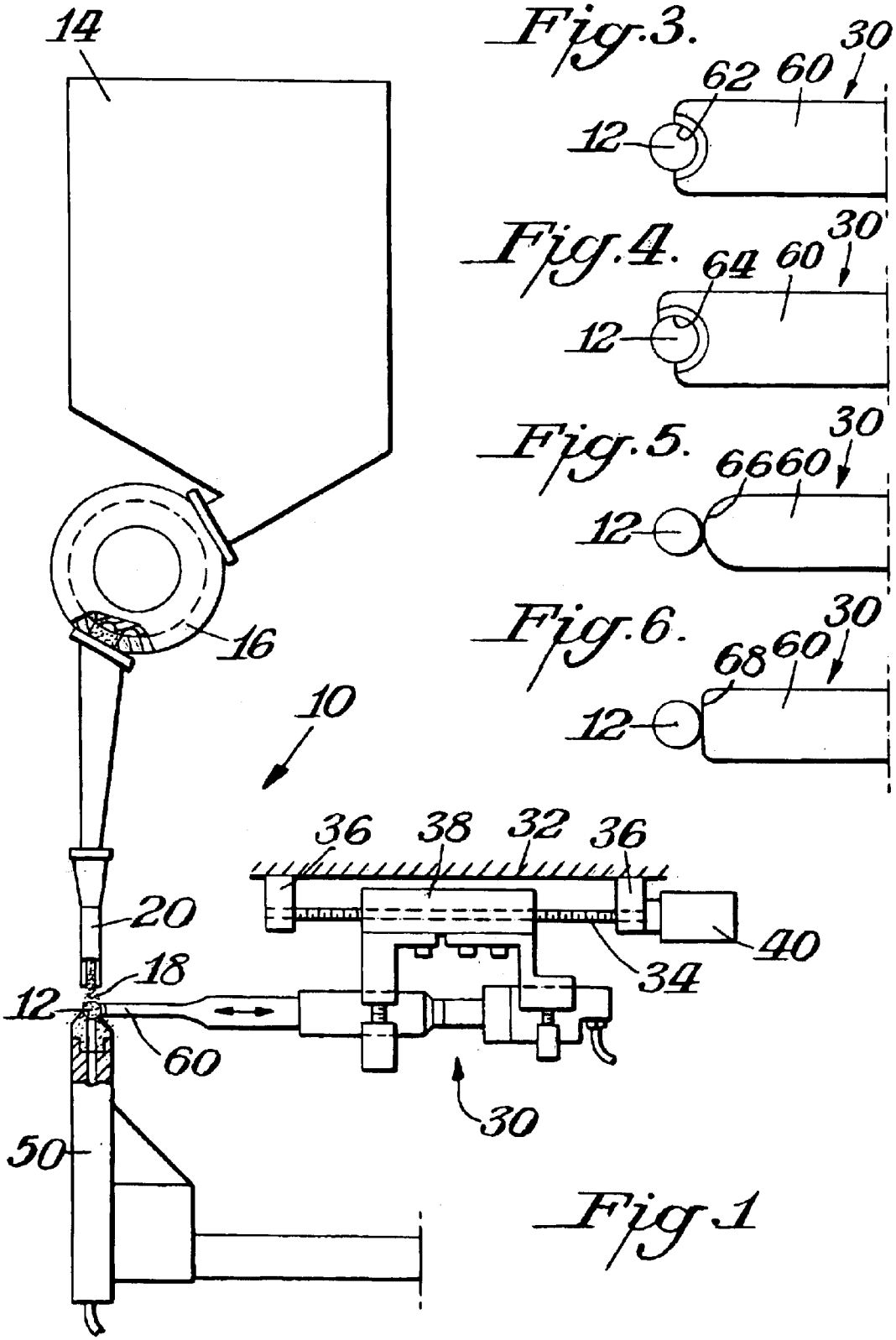
FIG. 1 is a side elevational view of an assembly for enhancing carbon granule retention and for removing excess granules from a filter plug preform using an ultrasonic welder horn, according to the present invention.
Figure 2:
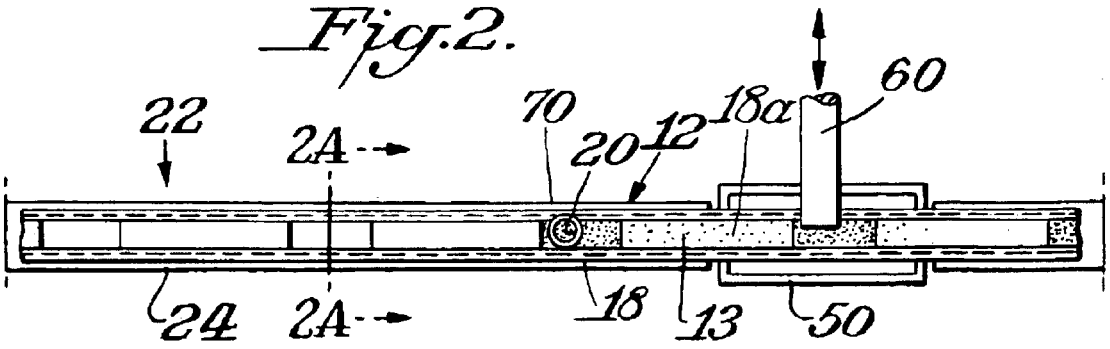
FIG. 2 is a partial top plan view of the assembly of FIG. 1 showing the roller conveyor for the filter plug preform.
Figure 2A:
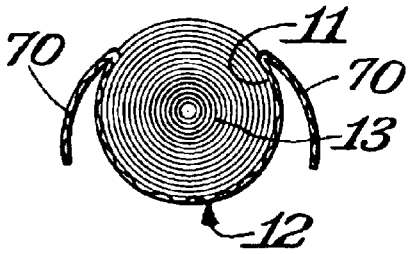
FIG. 2A is a sectional view taken along line 2A—2A of FIG. 2.

Referring in more particularity to the drawings, FIGS. 1, 2 and 2A illustrate an assembly 10 for enhancing the retention of particulate matter in the cavities 11 of a filter plug preform 12 and for removing any excess particulate matter therefrom. The term "preform" as used herein refers to a continuous rod of spaced apart wrapped solid segments 13 that form a plurality of open-topped cavities 11 there between. See FIGS. 2 and 2A. The term "particulate matter" refers to any granular material that one of ordinary skill in the art would recognize as suitable for use. Such materials include, but are not limited to, various forms of carbon and APS silica gel. Any reference herein to carbon should be broadly construed to include the term particulate matter.

Generally the filter plug preform includes cellulose acetate material segments 13 between the cavities 11, and the objective is to fill the cavities with particulate matter such as carbon while ultimately keeping the cellulose acetate material free of carbon. Assembly 10 includes a particulate matter hopper 14 with a motor driven metering device 16 connected at the lower end of the hopper. Carbon granules 18 or a similar smoke altering material are metered and delivered to a feed tube 20. Because the delivery is not stopped between cavities 11, some excess granules 18*a* will be deposited on the cellulose acetate segments 11. This excess material interferes with glue application at a later manufacturing step.

Filter plug preform 12 is continuously moved in a downstream direction by a transport 22 in the form of a conveyor belting 24. The filter plug preform is conveyed by the transport below the feed tube 20, and carbon granules 18 from the hopper 14 flowing through the feed tube are deposited in the cavities 11 of the preform. As the granules are deposited they rest within the cavities of the preform. Ultimately, the carbon laden preform cavities and adjacent cellulose acetate are fashioned into individual pieces for use in cigarette filters.

A vibrator 30 such as an ultrasonic vibrator, preferably the vibrational horn of an ultrasonic welder is positioned for engaging the preform 12 on the transport 22 and vibrating the preform to enhance carbon retention in the cavities 11. The vibration further serves to remove a significant amount of any excess carbon granules 18*a* from the cellulose acetate 13. It will be readily appreciated by one of ordinary skill in the art that a standard ultrasonic welder is not useful in the practice of the present invention as there is no need to join two components. Moreover, an ultrasonic welder includes an anvil as described in U.S. Pat. No. 5,772,814 against which the components to be joined are held together during a welding operation. As shown in FIG. 1, the ultrasonic horn 30 is secured to a mounting surface 32 by a motor driven lead screw 34. The screw is journaled to support bearings 36 and is received within a carriage 38 of the welder. As a drive motor 40 is activated the lead screw turns in one direction or the other thereby moving the ultrasonic horn toward and away from the transport 22 and filter plug preform 12.

Ultrasonic welders are old in the art and primarily used in welding operations to join multiple pieces of metal or plastic. Normally these welders vibrate in excess of 20,000 cycles per second. In the present invention the ultrasonic horn 30 is used as a tool to enhance retention of carbon granules in the cavities of filter plug preform 12 and also to remove excess carbon granules from the adjacent cellulose acetate material. U.S. Pat. Nos. 5,651,494, 5,772,814 and 6,089,438 describe ultrasonic welders and welding techniques in the traditional sense of welding several work pieces together. The content of each of these patents is fully incorporated herein by reference.

Assembly 10 may also include a vacuum 50 below transport 22 for receiving any excess carbon granules and recycling the granules back to hopper 14. Alternatively, any excess particulate matter may be disposed of if recycling is not desirable.

Horn 30 includes a horn tip 60, and the horn tip may have a concave preform engaging surface 62, 64 as shown in FIGS. 3 and 4. Concave surface 62 may extend less than 180° around the circumference of the preform, as shown in FIG. 3, and concave surface 64 may extend more than 180°, as shown in FIG. 4. Alternatively, the horn tip may have a convex preform engaging surface 66, as shown in FIG. 5, or a flat filter plug engaging surface 68, as shown in FIG. 6.

In operation, the horn 30 operates to settle the carbon granules in the cavities 11. Also, the horn causes the cellulose acetate to vibrate whereby any carbon on this material simply bounces away from the filter plug. It should be noted that the practice of the present invention does not require the complete removal of all excess material 18*a* from each segment. The purpose of the present invention is met if a significant portion of such material is removed. After the cavities are filled with carbon and excess material is addressed as just described, cover flaps 70 on the sides of preform are folded over the cavities and the cellulose acetate and secured in place.

Although the present invention has been described in connection with exemplary embodiments thereof, it will be appreciated by those skilled in the art that additions, deletions, modifications, and substitutions not specifically described may be made without departing from the spirit and scope of the invention as defined in the appended claims.

I claim:

1. An assembly for enhancing particulate matter retention in a moving cavity comprising:

a transport for continuously moving a plurality of cavities in a downstream direction;

a particulate matter supply;

a particulate matter feed for depositing particulate matter from the supply into the plurality of cavities; and a vibrator for engaging at least one wall of each cavity and vibrating the cavity to enhance particulate matter retention therein, and wherein the vibrator is an ultrasonic welder horn.

2. An assembly as in claim 1 wherein the ultrasonic welder horn includes a horn tip, and the horn tip having a concave cavity engaging surface.

3. An assembly as in claim 2 wherein the concave cavity engaging surface extends less than 180° around the cavity.

4. An assembly as in claim 2 wherein the concave cavity engaging surface extends more than 180° around the cavity.

5. An assembly as in claim 1 wherein the ultrasonic welder horn includes a horn tip, and the horn tip having a convex cavity engaging surface.

6. An assembly as in claim 1 wherein the ultrasonic welder horn includes a horn tip, and the horn tip having a flat cavity engaging surface.

7. An assembly for enhancing carbon granule retention in the cavities of a filter plug preform and for removing any excess carbon granules from the preform comprising:

a transport for continuously moving a filter plug preform in a downstream direction;

a carbon granule feed for depositing carbon granules into the cavities of the filter plug preform on the transport; and a vibrator engaging and vibrating the filter plug preform to enhance carbon granule retention in the cavities thereof and to remove any excess carbon granules therefrom.

8. An assembly as in claim 7 wherein the vibrator is an ultrasonic vibrator.

9. An assembly as in claim 7 including:

a vacuum source below the transport for receiving any excess carbon granules.

10. An assembly as in claim 9 including means for recycling carbon granules received by the vacuum source back to the supply.

11. An assembly for enhancing carbon granule retention in the cavities of a filter plug preform and for removing any excess carbon granules from the preform comprising:

a transport for continuously moving a filter plug preform in a downstream direction;

a carbon granule feed for depositing carbon granules into the cavities of the filter plug preform on the transport; and a vibrator for vibrating the filter plug preform to enhance carbon granule retention in the cavities thereof and to remove any excess carbon granules therefrom, and wherein the vibrator is an ultrasonic welder horn.

12. An assembly as in claim 11 wherein the ultrasonic welder horn includes a horn tip, and the horn tip having a concave filter plug engaging surface.

13. An assembly as in claim 12 wherein the concave filter plug engaging surface extends less than 180° around the circumference of the cavity.

14. An assembly as in claim 12 wherein the concave filter plug engaging surface extends more than 180° around the circumference of the cavity.

15. An assembly as in claim 11 wherein the ultrasonic welder horn includes a horn tip, and the horn tip having a convex filter plug engaging surface.

16. An assembly as in claim 11 wherein the ultrasonic welder horn includes a horn tip, and the horn tip having a flat filter plug engaging surface.

17. A method of enhancing particulate matter retention in the cavities of a filter plug preform and for removing excess particulate matter from the filter plug preform comprising the steps of:

transporting a filter plug preform in a downstream direction;

depositing particulate matter into the cavities of the filter plug preform from a particulate matter supply; and engaging the filter plug preform with an ultrasonic vibrational device to enhance particulate matter retention and to remove any excess particulate matter therefrom.

18. A method as in claim 17 wherein the step of engaging the filter plug preform is accomplished with an ultrasonic welder horn.

19. A method as in claim 17 wherein the step of vibration comprises ultrasonically vibrating the filter plug preform.

* * * * *